United States Patent [19]

Day

[11] 4,229,927

[45] Oct. 28, 1980

[54] PROCESS AND APPARATUS FOR VACUUM PACKING

[75] Inventor: Timothy T. Day, London, England

[73] Assignee: J. Sainsbury Limited, London, England

[21] Appl. No.: 949,176

[22] Filed: Oct. 6, 1978

Related U.S. Application Data

[63] Continuation-in-part of Ser. No. 799,868, May 23, 1977, abandoned.

[51] Int. Cl.[3] ..... B65B 31/02; B65B 47/02

[52] U.S. Cl. ..... 53/433; 53/453; 53/511; 53/559

[58] Field of Search ..... 53/533, 511, 432, 510, 53/453, 559

[56] References Cited

U.S. PATENT DOCUMENTS

| | | | |
|---|---|---|---|
| 3,673,760 | 7/1972 | Canamero et al. | 53/433 |
| 3,706,174 | 12/1972 | Young et al. | 53/510 |
| 3,736,721 | 6/1973 | Wolfelsperger | 53/433 |
| 3,754,372 | 8/1973 | Perdue | 53/511 |
| 3,950,919 | 4/1976 | Perdue | 53/433 |
| 3,956,867 | 5/1976 | Utz et al. | 53/433 |
| 3,992,850 | 11/1976 | Vetter | 53/510 |

*Primary Examiner*—Travis S. McGehee
*Attorney, Agent, or Firm*—Karl W. Flocks

[57] ABSTRACT

The invention concerns the packaging of commodities into vacuum-sealed packs formed from sheet plastics packaging material. In accordance with this invention, the packaging material is formed from a two-layer laminate the inside layer of which has a much lower softening point than the outside layer. The commodity is sandwiched between two sheets of the packaging material and is passed to a vacuum chamber in which it is sealed between the two sheets under reduced pressure. Simultaneously the material is heated to a temperature at which the inner laminate softens, and when the chamber is aerated, the heated material collapses around the commodity and the inner layers fuse together around the margins to form a highly effective hermetic seal around the commodity.

19 Claims, 4 Drawing Figures

PROCESS AND APPARATUS FOR VACUUM PACKING

This is a continuation-in-part of my co-pending application Ser. No. 799,868, filed May 23, 1977, now abandoned.

BACKGROUND OF THE INVENTION

This invention relates to a process and apparatus for packing commodities such as foodstuffs into vacuum-sealed packs, and is particularly applicable to the smaller sized packs which are used to contain foodstuffs such as rashers of bacon or small joints of meat sold through retail outlets.

Vacuum-sealed packs containing foodstuffs for domestic consumption generally consist of the foodstuff enclosed between two superposed films of plastics material which are sealed hermetically together around the periphery of the pack with a margin between the seal and the foodstuff. This margin may be as wide as 3 or 4 cm in places. The packs are sealed under a vacuum of e.g. 4 Torr to ensure that the food is kept fresh.

In one method of packing domestic cuts of meats such as bacon, a continuous film of stretchable plastics material is first deformed, for example by heat and vacuum, to provide a series of pockets for receiving the foodstuff. The stretched pocketed film is then fed to a packing station where the slices of bacon are loaded in succession into the pockets, and a second continuous film is then applied on top of the first film. The first or lower film is wider than the second or upper film so that the lower film is left with uncovered margins along opposite longitudinal edges.

The superposed films are then indexed to a vacuum sealing station where each pocket is received in a heated die which can be raised to bring the films into engagement with an upper die. The webs are clamped transversely between the dies but are not at this stage permanently sealed together; the longitudinal edges of the dies engage the margins of the lower web only; due to its narrow width, the upper web is not at this stage gripped along its longitudinal edges.

The space within the closed dies is then evacuated through ducts at the outer margins of the dies, and the air is drawn from the pocket via the free outer longitudinal edges of the upper web. A heating plate is then lowered to heat the upper web and to heat seal the superposed edges of the films around the whole periphery of the pocket; at the same time, the lower film is heated through the lower die.

On heating, the material shrinks into contact with the product in the pack and the chamber is simultaneously aerated so that the material collapses closely around the product. The dies are then separated and the sealed pack is moved out of the vacuum chamber and is replaced by a succeeding pack for the next cycle of sealing operations.

In this method, which has hitherto been applied only to heat shrinkable films, where a transverse row of pockets are indexed into the sealing chamber in each step evacuation of the pockets in the central region of the web is slow and inefficient as the air must pass across the outer pockets before it is removed via the edges of the web. In addition, relative alignment of the upper and lower webs must be exact in order to enable the dies to engage the margins of the lower web without trapping the upper web and preventing exhaustion of the pockets, and this is difficult to achieve in practice.

The method and apparatus of the invention provides an alternative means for achieving a vacuum-packed commodity in which the risk of leakage is extremely low and which can be performed at high speed.

SUMMARY

According to the present invention, there is provided a process for continuously packing commodities into vacuum-sealed packs formed from a pair of superposed films each of which comprises a laminate of two layers of plastics material one layer of which has a softening temperature below that of the other layer, comprising forming pockets successively in the direction of the web in a first, lower continuous web of said film which has the laminate with the lower softening point on its upper surface, putting the commodity to be packed into said pockets, laying a second, upper continuous web of said film onto the upper surface of said lower web with its lower softening point layer in contact with the upper surface of the lower web to overly the pockets containing the commodities, advancing the superposed webs to a vacuum sealing and heating chamber, enclosing at least one of the pockets in the vacuum sealing and heating chamber, evacuating the interior of the chamber and hence the interior of the pocket and simultaneously heating the web material within the chamber, heat sealing the two superposed films together around the periphery of the pocket, and aerating the interior of the chamber to cause the heated films to collapse around the commodity in the pocket, the films in the chamber being heated to a temperature such as to cause the inner laminates of the films of soften and fuse together around the commodity.

During heating of the superposed films in the vacuum sealing and heating chamber, the temperature of the films is raised to a level such as to cause the inner laminates to become substantially molten. The outer laminates have a much higher softening temperature and are thus not affected by the heat applied to the films. When the vacuum chamber is aerated, the material of the packs collapses around the product and fuses together around the margins of the packs, thus providing a vastly better hermetic seal than has been achieved hitherto using conventional vacuum-packing techniques.

In the method of the invention, it is preferred that a plurality of pockets are formed transversely across the width of the web, and the vacuum sealing and heating chamber is adapted to receive at least one row of such pockets at a time. In practice, the vacuum chamber can be constructed to receive at least two rows of the transverse pockets, and the two films are then indexed stepwise by a distance which corresponds to the width of a double row of pockets.

In the preferred form of the invention, the method includes slitting the upper web longitudinally prior to the films being passed to the vacuum sealing and heating chamber, said slit extending centrally along the length of the web between pockets which are adjacent across the width of the web. This enables the pockets to be evacuated through the slits rather than through the edge regions of the web and this substantially improves the air flow from the interior of the pockets during the evacuation process. Advantageously, prior to evacuation of the chamber, the two films may be heat sealed together around part of the periphery of the pocket, and where more than one pocket is provided across the width of the web, the films are heat sealed together prior to evacuation of the chamber by a peripheral seal formed around the outside of each row of pockets in the chamber, thus leaving a central or longitudinal slit through which the pockets can subsequently be evacuated.

More than one slit may be provided in the upper web where a large number of pockets are provided in each row.

On evacuation of the pockets through the or each slit, the seal around the pack is completed by means of a sealing bar, which is operable to seal the films together on either side of the respective slit. The sealing bar may also act as an evacuation duct by the provision of ports in the outside edges of the bar.

In an embodiment of the invention, evacuation of the chamber may continue after all the peripheral seals have been formed around each pocket, to cause the material of the pockets to inflate for optimum contact with the heated surfaces within the chamber.

In another embodiment of the invention, transverse seals may be applied between adjacent rows of pockets before the pockets are advanced into the vacuum sealing and heating chamber so as to prevent relative movement between the upper and lower films during the evacuation and heating operation.

Preferably, the plastics material of the upper and lower films comprises a nylon/polythene laminate in which the nylon layer has a softening point around 240° C. and the polythene layer has a softening point around 110° C.

The invention also includes apparatus for packing commodities into vacuum-sealed packs formed from a pair of superposed films each of which comprises a laminate of two layers of plastics material one layer of which has a softening temperature below that of the other layer, comprising means for successively forming in a first, lower continuous web of said film successive rows of pockets across the width of the web which pockets are adapted to receive the commodites, means for superposing a second, upper continuous web of said film onto the upper surface of the lower film to overly the pockets containing the commodities, slitting means for slitting the upper web longitudinally thereof along a line which extends intermediate adjacent pockets in the lower web, a vacuum sealing and heating chamber for receiving the superposed upper and lower webs, heating means within the evacuation and heating chamber for heating the upper and lower webs, sealing means for sealing together the upper and lower webs around part of the peripheries of the pockets, evacuation means for evacuating the interior of the vacuum chamber and the interior of the pockets, further sealing means for sealing together the upper and lower webs around the remainder of the peripheries of the pockets, and means for advancing the superposed webs in a step-by-step manner through the vacuum sealing and heating chamber.

Preferably, the vacuum sealing and heating chamber comprises a fixed upper part incorporating heating means, and a vertically displaceable lower part also incorporating heating means which is provided with die surfaces which generally match the shape of the pockets.

In order to achieve displacement of the lower part of the chamber, this part is preferably connected to a cylinder and piston assembly operable to move said lower part between a raised position in which it engages the upper part of the chamber to form a vacuum enclosure, and a lowered position in which entry and exit of the pockets takes place.

Advantageously the sealing means comprise mating surfaces provided on the upper and lower parts of the vacuum chamber which surfaces are adapted to engage the web material when the lower part is in the raised position.

The further sealing means suitably comprises a sealing bar located in the upper part of the chamber which bar extends longitudinally in the direction of movement of the web and is movable vertically between a raised position and a lowered position in which the bar mates, through the web material, with a surface formed on the lower part of the chamber. The axis of this sealing bar is aligned with said slitting means and the sealing bar is adapted to seal the upper and lower webs together on both sides of the longitudinally extending slit formed by the slitting means, and the sealing bar may be provided with apertures communicating with a vacuum port located in the vacuum sealing and heating chamber. This ensures that air is drawn from the interior of the pockets by a port located closely adjacent to the longitudinal slit. Air ports are also provided in the lower dies.

Advantageously, the heated surfaces in the chamber are coated with a non-stick material such as PTFE to prevent the softened plastics material from sticking to the die surfaces.

Preferably, operation of the sealing bar is controlled by means sensitive to the degree of vacuum within the evacuation chamber. The period during which the lower die is in the raised position is also suitably controlled by the degree of vacuum within the chamber.

The apparatus suitably includes transverse sealing means located upstream of the vacuum sealing and heating chamber adapted to make transverse seals between adjacent rows of pockets across the width of the web prior to the pockets passing to the vacuum sealing and heating chamber. This prevents relative movement between the upper and lower webs during the vacuum sealing operation.

The apparatus also suitably includes severing means for separating the individual packs from the web after the vacuum sealing operation is completed.

DESCRIPTION OF THE PREFERRED EMBODIMENT

Figure 1:
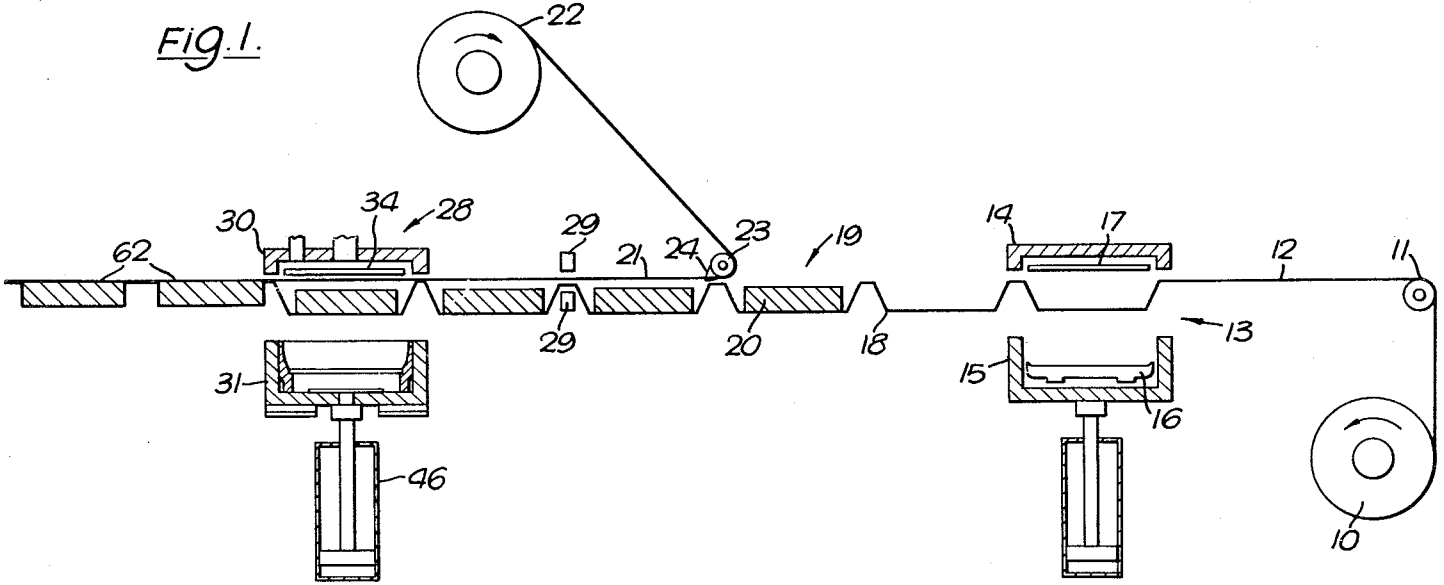
FIG. 1 is a schematic representation of the apparatus according to the invention in operation, showing parts of the apparatus in longitudinal section.

Referring to the drawings, FIG. 1 shows apparatus for continuously packing rashers of bacon or small joints of meat into vacuum sealed packs formed from two superposed sheets each of which comprises a two-layer laminated plastics material.

It will be appreciated that while the invention is described in connection with the packaging of foodstuffs, it is equally applicable to other commodities which must be packed and maintained under vacuum.

Sheet plastics material intended to form the base part of the packs is drawn from a reel 10 and after passing over a roller 11 is advanced horizontally through the various stages of operation in the form of a continuous base web 12.

The material is a two-layer laminated plastics film having one layer which has a much lower softening temperature than the other layer. In the case of the base web 12, the layer with the lower softening point is disposed on the upper side of the web.

A suitable plastics laminate film is a nylon-polythene laminate having a first layer of nylon of a thickness of 30 microns with a softening point of 240° C. and a second layer of polythene which is 70 microns thick and with a softening point of 115° C. A lower melting point polythene of 70 microns thickness with a softening point of 105° C. may also be used for the low-melting point layer.

The first stage of the operation comprises the forming of successive pockets in the lower film in a heated pocket-forming apparatus generally indicated at 13. The pocket-forming apparatus comprises a heated vacuum chamber formed by a fixed upper part 14 and a vertically displaceable lower part 15 which incorporates a die 16 and a heating device which causes the whole of the lower chamber and the cast metal e.g. aluminium inserts to reach a temperature of 125° C. A heating element 17 is located in the upper part 14.

The base web 12 is indexed through the pocket-forming device in a step-by-step manner, entering and leaving the chamber with the lower part 15 in the down position shown in FIG. 1. When the web to be formed passes into the device 13, the lower part 15 is raised to close the chamber onto the base web 12, forming a hermetic seal around the margins of the chamber, and the heating plate 17 (which is continuously heated) softens the material of the web. The chamber is then evacuated through apertures in the die 16, and the softened material is sucked into the heated lower part of the chamber, conforming to the shape of the die 16. The vacuum is then released to leave the formed pocket in the web. The lower part 15 is displaced downwardly to allow removal of the formed pocket, and the pocket is indexed out of the apparatus.

In the device 13, pockets are formed in adjacent pairs across the width of the web in a single operation of the pocket-forming device, although they may be formed singly or in any number (either transversely across or in the direction of movement of the web) depending on the size of the pockets and the dimensions of the apparatus. For example, in one form of the apparatus, the pocket-forming device 13 is adapted to form pockets in sets of four, two transversely across the web and two longitudinally in the direction of the web. The die 16 is exchangeable so that different shapes and numbers of pockets can be formed to suit the commodities to be packed.

In accordance with this invention, the pockets are formed by thermoplastic deformation of the web 12, and the web is unstressed after the pocket-forming operation, unlike similar operations with shrink films in which the material is stretched when the pockets are formed and left in a stressed condition.

The lower web 12 with the pockets 18 formed in this operation passes from the pocket-forming device 13 to a filling station generally indicated at 19 where they are filled either by hand or automatically by machine with the commodity 20 to be packed, which in this case is either bacon or small joints of meat.

Beyond the filling station 19 the upper web material 21 is applied to overly the lower web 12, covering the commodities filling the pockets 18. The upper web 21 is of the same laminated plastics material as the lower web, and is drawn from a reel 22, passing over a roller 23 before it is laid over the web 12. In this case the laminate with the lower softening point is on the lower side of the web, so that the low-softening point layers of the two webs face each other and contact each other around the margins of the pockets.

Figure 4:
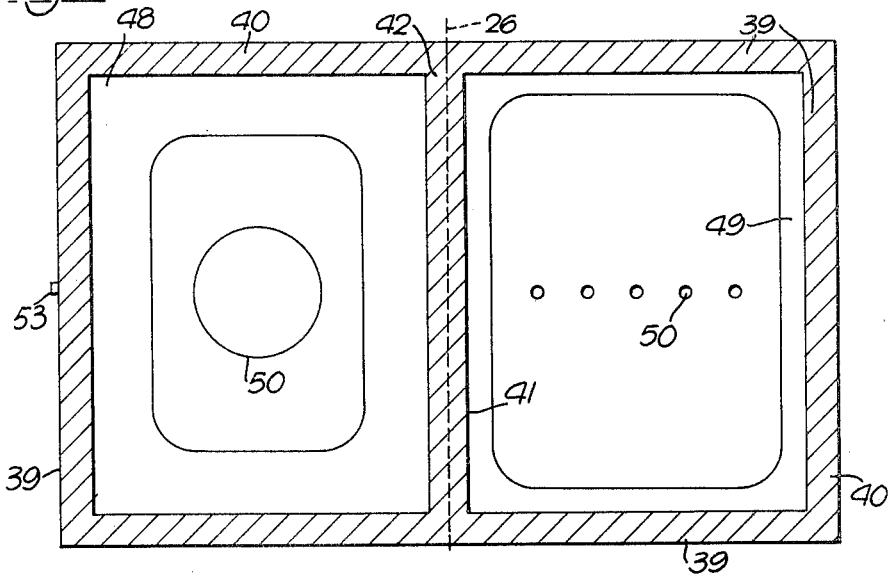
FIG. 4 is a plan view of the lower part of the vacuum sealing chamber shown in FIG. 3.

Simultaneously with passing over the roller 23, the upper web is slit longitudinally by a knife 24 so that the web approaches the vacuum sealing station generally indicated at 28 with a central dividing slit (the position of which is shown in dotted line 26 in FIG. 4), the dividing slit extending centrally between transverse pairs of pockets 18.

Before passing to the vacuum sealing station 28, the superposed films pass between a pair of impulse sealing bars 29 which, as the webs are indexed step-by-step through the apparatus, seal the two films together in a transverse direction between each pair of pockets. These seals, which extend across the full width of the web, ensure that the webs maintain their relative position as they pass through the remaining stages of operation.

Figure 3:
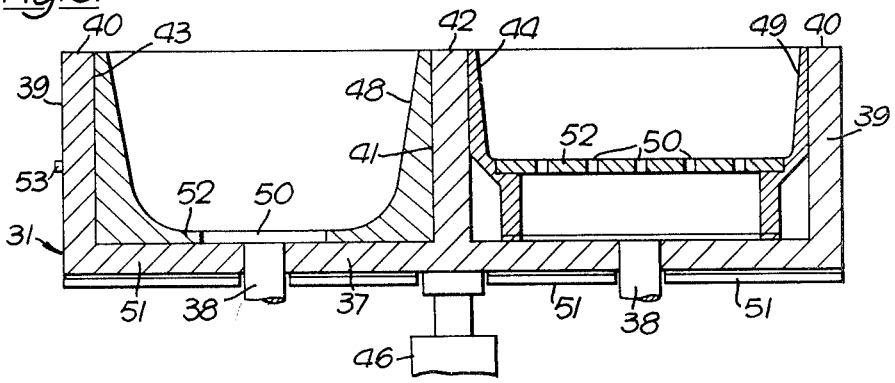
FIG. 3 is a transverse cross-sectional view of the lower part of the vacuum sealing chamber.
Figure 2:
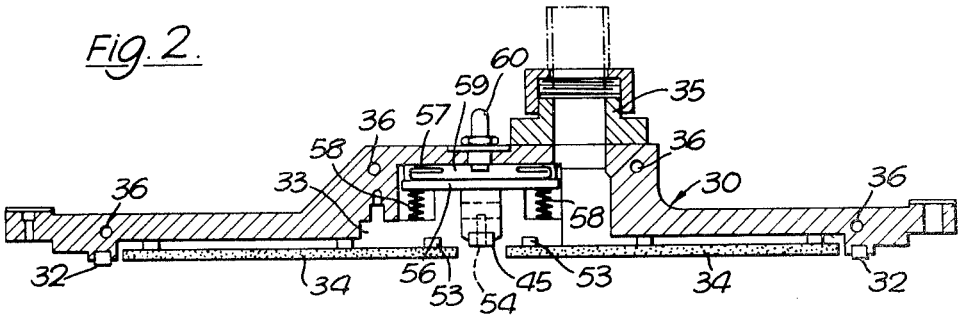
FIG. 2 is a transverse cross-sectional view of the upper part of the vacuum sealing chamber.

The vacuum sealing chamber 28 is shown in detail in transverse section in FIGS. 2 and 3 and comprises an upper part 30 (FIG. 2) and a lower part 31 (FIG. 3). Both parts are formed from a material such as aluminium alloy having good heat conducting properties. The upper part 30 is fixed and is provided with a peripheral sealing wall 32 defining a space 33 in which are located a pair of heating plates 34 incorporating resistance heating elements. The space 33 is provided with a main vacuum port 35, and water cooling ducts 36 are located in the upper part 30 connected to a common water supply (not shown).

Due to the restricted space within the vacuum sealing chamber, and the heating plates 34 are only around 5 mm in thickness and are formed from an electrically conductive mesh or film embedded in a sheet rubber material which is sandwiched between a pair of metal plates. The outer surfaces of the plates which contact the web material may be coated with a non-stick layer such as PTFE.

The lower part 31 of the vacuum chamber comprises a base 37 provided with vacuum ports 38 and boundary wall members 39 having upper edges 40 which are engageable with the peripheral sealing wall 32 of the upper part 30. The lower part 31 also has a longitudinal dividing wall 41 extending in the direction of movement of the webs and having an upper surface 42 which is engageable (as will be described) with a movable sealing bar 45 located in the upper part 30.

The entire lower section 31 is vertically movable (as illustrated in FIG. 1) between a down position in which entry and exit of the pockets 18 into the chamber takes place, and a raised position adopted during the vacuum sealing operation. To this end, the lower part 31 is mounted on the piston rod of an air cylinder and piston assembly 46 and this vertical movement is controlled in timed relation with the step-by-step advance of the pockets through the vacuum sealing station.

The boundary walls 39 and wall 41 divide the lower part 31 into two sections 43, 44 and dies 48, 49 each shaped to receive a pocket 18 are located respectively in these sections. These dies are interchangeable to suit the size of the pockets and two different die sections are shown in FIG. 3, the die 49 on the right-hand side of the drawing being intended for bacon rashers and the die 48 on the left-hand side of the drawing being intended for meat joints. In practice, the dies will generally be the same in each section. The dies are located only by the walls 39 and 41 and can be removed by simply lifting them out of the appropriate sections.

The dies are provided with vacuum ports 50 communicating with the vacuum ports 38.

The lower part 31 and hence the dies 48, 49 are electrically heated by heating elements 51 located on the outside of the lower part 31. These heating elements are of the same construction as the heating plates 34. During operation of the apparatus these heating elements are operated continuously, as are the heating plates 34. The elements 51 raise the temperature of the die surfaces to around 120° C., and in order to improve the heat transfer properties of the base part 31, the dies are suitably made of a good heat-conducting material such as aluminium alloy. Thermocouples 53 are provided in the upper part 30 and on the outside of the base part 31 for monitoring the temperatures of these parts, and these thermocouples may be operable to control the current supply to the heaters for example to maintain a constant pre-set temperature. As fusion is not required at the bottoms of the pockets, the bases 52 of the dies are formed of a non-heat conductive material to reduce overheating of the commodity.

As the pockets are advanced into the vacuum sealing station, the lower part of the chamber 31 is in the down position as shown in FIG. 1. Following the indexing operation, the air cylinder 46 is operated and the lower part 31 is raised into engagement with the upper part 30, trapping the upper and lower webs between the hot upper surfaces 40 of the walls 39, and the peripheral wall element 32 of the upper part 30, and hermetically sealing the inside of the vacuum chamber. The two webs fuse along this line of contact, and a seal is formed extending completely around the periphery of the pockets within the vacuum chamber. The interior of the pockets remain open to the interior of the vacuum chamber only through the central longitudinal slit extending along the dotted line 26 in FIG. 4.

In the closed position of the parts 30, 31, the upper web 21 is in contact with the heating plates 34, and the pockets 18 are in close contact with the walls of the dies 48, 49. The heat imparted by the plates and the dies quickly raises the temperature of the web material, and simultaneously the interior of the vacuum chamber is evacuated through main vacuum port 35 and vacuum ports 38. Air is drawn out of the pockets through the central slit, and the interior of the vacuum chamber and the pockets is evacuated to a value of around 4 Torr.

During operation, the longitudinal slit extends in the same direction and slightly below the sealing bar 45, and in order to speed up the evacuation of the pockets, the transverse sealing bar 45 is provided with drillings 54 which terminate in bores 55 which communicate with the central cavity 33 of the vacuum chamber. The location of the sealing bar 45 also prevents the fore edges of the upper web on either side of the slit from "curling" in the air stream and preventing subsequent sealing.

The sealing bar 45 is mounted on the base of a plate 56 connected to the upper part of the vacuum chamber by bellows 57 which are normally urged into a collapsed position (shown in FIG. 2) by compression springs 58; the interior 59 of the bellows is connected to a compressed air port 60, and on reaching a predetermined level of vacuum in the vacuum chamber (and hence in the pockets), the compressed air line connected to port 60 is energised, and the sealing bar 45 is forced downwards against the pressure of the springs 58 into contact with the upper web on either side of the slit. The bar 45 presses the web material against the hot upper surface 42 of the dividing wall 41, forming a seal along both sides of the slit, which completes the peripheral seal around the boundaries of the individual pockets.

At this stage of the operation, the heat imparted to the webs by the heated surfaces in the chamber has caused the inner, low-melting point layers to become molten, and at a predetermined vacuum the valves controlling the vacuum ports are opened, aerating the chamber and causing the web material to collapse around the product in the pockets. At the contacting margins of the webs i.e. in the zones between the pockets and at the sides of the pockets the web material fuses together, forming a perfect hermetic seal around the commodity. The lower part 31 of the vacuum chamber is then displaced downwardly into the position shown in FIG. 1, and the evacuated and fused packs 62 are indexed out of the machine and passes to a slitting station where they are separated from each other and from the remainder of the web material.

By virtue of the complete fusing of the opposite films around the commodities, the number of leaking packs produced in this apparatus is extremely low compared to most known methods of packing; in practice, a reduction in the number of leaking packs of around 95% has been achieved with the apparatus and method of the invention.

A number of modifications to the method and apparatus described are possible without departing from the scope of the invention. For example, in one embodiment, once the peripheral seals have been formed around the packs vacuum may continue to be drawn through the vacuum ports, causing the air pressure in the vacuum chamber to be reduced to a value below that present in the sealed pockets. This causes the sealed web material to inflate, forming optimum contact conditions between the material and the heated surfaces of the plates 34 and dies 48,49.

In a further modification, the web material may be perforated along lines which are located in the margins of the sealed packs in order to assist in the evacuation of the pockets. Due to the ultimate fusing of the films, these holes are closed when the packs are finally formed.

I claim:

1. A process for successively packing commodities into vacuum-sealed packs formed from a pair of superposed flexible films each of which comprises a laminate of two flexible layers of plastics material one dominating layer of which has a softening temperature below that of the other layer, comprising thermoforming unstretched depending pockets successively in a lower continuous web of a first film by thermoplastic deformation of but without stressing said film which has the laminate with the lower softening point on its upper surface, said thermoplastic deformation to form pockets taking place above the softening point of said dominating layer, putting a commodity to be packed into each of said unstretched thermoformed pockets, laying an upper continuous web of a second film onto the upper surface of said lower web with lower softening point layer in contact with the upper surface of the lower web in overlying relation to the pockets containing the commodities, impulse sealing said films transversely of the web between the pockets, advancing the superposed webs to a vacuum sealing and continuously heated chamber, enclosing at least one of the pockets in said chamber, hermetically sealing said chamber, heat sealing said films together around the pocket periphery leaving an opening and evacuating the interior of the chamber and the interior of the pocket and simultaneously heating above the softening point of adjacent layers of said two films within the chamber, closing said opening and sealing said pocket under vacuum and aerating the interior of the chamber to cause the heat softened films to collapse without shrinking around the commodity in the pocket, the films in the chamber being heated to a temperature above the softening point of the low melting point layers so as to cause the portions of the inner layers of the films which are in contact with each other to soften sufficiently to fuse together around the commodity on aeration of the chamber.

2. A process as claimed in claim 1, wherein a plurality of pockets are formed transversely across the width of the web, and the vacuum sealing and heating chamber is adapted to receive at least one row of such pockets at a time.

3. A process as claimed in claim 2, wherein said opening is formed by slitting the upper web longitudinally prior to the films being passed to the vacuum sealing and heating chamber, said slit extending along a line substantially intermediate adjacent pockets across the width of the web.

4. A process as claimed in claim 1 wherein said opening is formed by providing a slit in the upper film.

5. A process as claimed in claim 4, wherein the films are heat sealed together around the entire periphery of the row of pockets to leave the longitudinal slit extending between adjacent pockets through which the pockets can subsequently be evacuated.

6. A process as claimed in claim 5, wherein on evacuation of the pockets through the slit, the seal around each pocket is completed by longitudinal sealing means operable to seal the films together on either side of said slit.

7. A process as claimed in claim 1, wherein evacuation of the chamber continues after all the peripheral seals have been formed around each pocket, thereby causing the material of the pockets to inflate into improved thermal contact with heating means located within the vacuum sealing and heating chamber.

8. A process as claimed in claim 1, wherein the pockets are formed in a plurality of adjacent rows and transverse seals are applied before adjacent rows of pockets before the pockets are advanced into the vacuum sealing and heating chamber so as to prevent relative movement between the upper and lower films during the evacuation and heating operation.

9. A process as claimed in claim 1, wherein the plastics material of the upper and lower films comprises a nylon/polythene laminate in which the nylon layer has a softening point around 240° C. and the polythene layer has a softening point around 110° C.

10. Apparatus for continuously packing commodities into a succession of vacuum-sealed packs formed from a pair of superposed films each of which comprises a laminate of two layers of flexible plastics material one layer of which has a softening temperature below that of the other layer, comprising heated pocket forming means for successively heat forming in a first, lower continuous web of said film successive rows of pockets across the width of the web and adapted to receive the commodities, means for superposing a second, upper continuous web of said film onto the upper surface of the lower film to overly the pockets containing the commodities, slitting means for slitting the upper web longitudinally thereof along a line which extends intermediate adjacent pockets in the lower web, a vacuum sealing and continuously heatable chamber for receiving successive loaded pockets in the superposed upper and lower webs, heating means within the evacuation and heating chamber for heating at least the upper web therein, sealing means for sealing together the upper and lower webs in the heated chamber along part of the peripheries of the pockets, evacuation means for evacuating the interior of the vacuum chamber and the interior of the partly sealed pockets, and further sealing means for sealing together the upper and lower webs along the remainder of the peripheries of the evacuated pockets, said further sealing means being provided with a passage for communicating said evacuation means with the interior of said pockets in the location of the remainder of pocket peripheries, means being provided for advancing the superposed webs in a step-by-step manner successively through the apparatus.

11. Apparatus as claimed in claim 10, wherein the vacuum sealing and heating chamber comprises a fixed upper part incorporating heating means, and a vertically displaceable lower part also incorporating heating means which is provided with die surfaces which generally match the shape of the pockets.

12. Apparatus as claimed in claim 11, wherein the lower part of the chamber is connected to a cylinder and piston assembly operable to move said lower part between a raised position in which it engages the upper part of the chamber to form a vacuum enclosure, and a lowered position in which entry and exit of the pockets takes place.

13. Apparatus as claimed in claim 12, wherein the sealing means for sealing together the upper and lower webs around part of the peripheries of the pockets comprises mating surfaces provided on the upper and lower parts of the vacuum chamber which surfaces are adapted to engage the web material and when the lower part is in the raised position.

14. Apparatus as claimed in claim 10, wherein said further sealing means comprises a sealing bar located in the upper part of the chamber which bar extends longitudinally in the direction of movement of the web and is movable vertically between a raised position and a lowered position in which the bar mates, through the web material, with a surface formed on the lower part of the chamber.

15. Apparatus as claimed in claim 14, wherein the axis of the sealing bar is aligned with said slitting means and the sealing bar is adapted to seal the upper and lower webs together on both sides of the longitudinally extending slit formed by the slitting means.

16. Apparatus as claimed in claim 14, wherein the sealing bar is connected to the upper part of the vacuum sealing and heating chamber by means of a bellows arrangement the interior of which is connected to a compressed air port, and the sealing bar is normally urged into a raised position by means of compression springs acting on the lower part of the bellows.

17. Apparatus according to claim 10, wherein the heating means in the upper part of the vacuum sealing and heating chamber comprise one or more flat heating plates incorporating electric resistance heaters.

18. Apparatus as claimed in claim 17, wherein the heated surfaces within the vacuum sealing and heating chamber which in use contact the web material are coated with a non-stick composition.

19. Apparatus as claimed in claim 10, including transverse sealing means located upstream of the vacuum sealing and heating chamber adapted to make transverse seals between adjacent rows of pockets across the width of the web prior to the pockets passing to the vacuum sealing and heating chamber, and severing means for separating the individual packs from the web after the vacuum sealing operation is completed.

* * * * *